US009103108B2

(12) United States Patent
Lin

(10) Patent No.: US 9,103,108 B2
(45) Date of Patent: Aug. 11, 2015

(54) DRYWALL BACKING CONNECTOR FOR STEEL STUDS

(71) Applicant: Simpson Strong-Tie Company, Inc., Pleasanton, CA (US)

(72) Inventor: Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 14/088,343

(22) Filed: Nov. 22, 2013

(65) Prior Publication Data

US 2015/0143770 A1 May 28, 2015

(51) Int. Cl.

| | |
|---|---|
| ***E04B 1/19*** | (2006.01) |
| ***E04B 2/76*** | (2006.01) |
| ***E04C 3/30*** | (2006.01) |
| *E04C 3/02* | (2006.01) |

(52) U.S. Cl.

CPC ..... *E04B 1/1903* (2013.01); *E04B 2/76* (2013.01); *E04C 3/30* (2013.01); *E04C 2003/026* (2013.01)

(58) Field of Classification Search

CPC ..... E04B 1/1903; E04B 1/19; E04B 1/1942; E04B 1/1951; E04B 1/199; E04B 1/24; E04B 1/2403; E04B 2/56; E04B 2/562; E04B 2/58; E04B 2/60; E04B 2/62; E04B 2/76; E04B 2/762; E04B 2/764; E04B 2/765; E04B 2/766; E04B 2/767; E04B 2/78; E04B 2001/2415; E04B 2001/2448; E04B 2001/2496; E04C 3/00; E04C 3/04; E04C 3/0404; E04C 3/06; E04C 3/09; E04C 3/30; E04C 3/32; E04C 2003/026

USPC ..... 52/655.1, 317, 349, 696, 697, 481.1, 52/27, 666–668, 763, 764, 768, 770, 771, 52/777, 778, 779, 781

See application file for complete search history.

(56) References Cited

U.S. PATENT DOCUMENTS

| | | | | |
|---|---|---|---|---|
| 960,197 | A | 5/1910 | Priddle | |
| 4,453,362 | A * | 6/1984 | Rodgers | 52/481.1 |
| 4,471,592 | A | 9/1984 | MacKinnon, Jr. et al. | |

(Continued)

FOREIGN PATENT DOCUMENTS

| | | |
|---|---|---|
| DE | G9413917.2 | 12/1994 |
| JP | U-06306949 A | 11/1994 |
| JP | U-06307022 A | 11/1994 |

OTHER PUBLICATIONS

"U-Channel Bridging Connectors for Cold-Formed Steel Construction", Simpson Strong-Tie Product Brochure, Aug. 2012, p. 1-11 and back cover, F-SUBHMSUBH12, Simpson Strong-Tie Company, Pleasanton, CA.

(Continued)

*Primary Examiner* — Jessica Laux

(74) *Attorney, Agent, or Firm* — James R. Cypher; Charles R. Cypher

(57) ABSTRACT

A connection between standard metal studs with a separate backing connector is provided. The backing connector has a planar backing web with lateral longitudinal flanges that receives the lip flange of a first wall stud and a projecting tab that interfaces with the side member of the first wall stud. The backing connector also has members that interface with and attach to selected portions of the surfaces of the second wall stud without engaging the lip flange of the second wall stud. The backing connector is adjustable in length.

34 Claims, 12 Drawing Sheets

(56) References Cited

U.S. PATENT DOCUMENTS

| | | | | |
|---|---|---|---|---|
| 4,596,101 | A | 6/1986 | Brinker | |
| 4,619,304 | A | 10/1986 | Smith | |
| 4,658,556 | A | 4/1987 | Jenkins | |
| 4,696,132 | A | 9/1987 | LeBlanc | |
| 4,976,075 | A | 12/1990 | Kaveckis et al. | |
| 5,189,857 | A | 3/1993 | Herren et al. | |
| 5,245,811 | A | 9/1993 | Knorr | |
| 5,249,400 | A | 10/1993 | Turner | |
| 5,551,200 | A | 9/1996 | Krug | |
| 5,768,841 | A | 6/1998 | Swartz et al. | |
| 6,189,277 | B1 | 2/2001 | Boscamp | |
| 6,253,529 | B1 | 7/2001 | DeBoer | |
| 6,260,318 | B1 * | 7/2001 | Herren | 52/317 |
| 6,334,287 | B1 | 1/2002 | Fick | |
| 6,389,762 | B2 | 5/2002 | Le Poire | |
| 6,487,825 | B1 | 12/2002 | Sillik | |
| 6,705,056 | B2 * | 3/2004 | Tollenaar | 52/317 |
| 7,331,149 | B2 | 2/2008 | Tollenaar | |
| 7,428,804 | B2 | 9/2008 | Surowiecki | |
| 7,520,100 | B1 | 4/2009 | Herrman et al. | |
| 7,559,519 | B1 | 7/2009 | Dragic et al. | |
| 8,205,402 | B1 | 6/2012 | diGirolamo et al. | |
| 8,689,508 | B2 * | 4/2014 | Orszulak et al. | 52/317 |
| 2010/0058706 | A1 | 3/2010 | Trump | |
| 2010/0126113 | A1 | 5/2010 | Belanger | |

OTHER PUBLICATIONS

"Metal-Lite: Solutions for the Metal Stud Framing Industry", Online source: http://www.metal-lite.net, one page, published 2012, accessed Sep. 20, 2013, Metal-Lite, Crossville, TN, USA.

"Mantisgrip" Product Catalog, 2012, front cover and pp. 2-11, www.mantisgrip.com, Washington, USA.

"Light Steel Framing Connections", catalog, Nov. 2013, front and back cover and pp. 72-74, The Steel Network, USA.

"Clip Express Product Catalog", catalog, Apr. 2012, front and back cover and pp. 76-77 and 81-83, ClarkDietrich Building Systems, USA.

"Full Line Product Catalog", catalog, Sep. 2014, front and back cover and pp. 27-27 and 97, ClarkDietrich, USA.

* cited by examiner

DRYWALL BACKING CONNECTOR FOR STEEL STUDS

BACKGROUND OF THE INVENTION

1. Field of the Invention

The present invention relates to wall construction, and more particularly to a method and apparatus for providing a connection between a pair of wall studs to provide a backing connector for anchoring wall mounted structures such as cabinets, handrails and grab bars.

2. Description of Prior Art

Historically, the framework of a light framed building wall was formed entirely of wood members, such as wood studs and top and bottom sills. In recent years, however, the use of metal studs has gained acceptance, especially in commercial buildings, but also in residential construction. Some designers prefer to use metal studs rather than wood studs. Galvanized steel studs can be considered stronger than wood in some respects, will not rot, and are not subject to damage by pests such as termites.

Metal studs are typically formed of sheet metal bent to encompass a cross sectional area having nominal dimensions of two inches by four inches. To conform to architectural plans and building code requirements, metal studs are formed of sheet metal bent into a generally C-shaped cross-section in which a relatively broad central web is flanked by a pair of narrower sides that are bent at right angles to the web. The web typically has a uniform nominal width of either four inches or 3⅝ inches. The sides of the C-shaped stud typically extend to a nominal distance of two inches from the web. To enhance structural rigidity to the flanges of the stud, the flanges are normally bent over into a plane parallel to and spaced from the plane of the web. These turned over edges of the sides thereby form marginal lips which are typically one quarter to one half inch in width. Conventionally, the metal studs are erected with the webs oriented on the same side in the same direction.

In building construction, there are certain situations which require the building studs to be braced or linked transversely to provide enhanced structural rigidity. The studs must be transversely bridged when they are over eight feet in length so that they provide adequate stability in a lateral direction within the wall which they support.

In certain instances, the metal studs require transverse backing between the studs in a building so as to provide structural support against forces acting normal to or parallel to the plane of the wall assembly. For example, structural backing must be provided between adjacent parallel studs to provide necessary structural stability for the installation of wall structures such as cabinets, hand rails and grab bars. Hand rails and grab bars may have to conform to requirements of the Americans with Disabilities Act, i.e., withstand 250 pounds of point load pressure outward and downward parallel to the plane of the wall. A common way to provide backing is to shape pieces of plywood between adjacent studs and use screw fasteners to attach these pieces to adjacent studs. The number and placement of backing plywood pieces is determined by how much of the framework needs backing.

The use of fire-stops, bridging and backing in construction trade is well known in the prior art, and there are a number of patents that teach especially made backing pieces, bridging members and blocking members that are formed from sheet metal for use with sheet metal studs. Construction Codes and Fire Codes require that these devices be positioned between metal studs to: (1) reinforce uniformly laterally spaced parallel metal studs; (2) discourage the spread of fire, smoke and gases within interior walls; and (3) anchor hand rails and grab bars to metal studs. Typically, drywall (also known as plasterboard, wallboard, gypsum board, sheetrock, or gyprock) panels cover the studs and backing and is attached thereto.

SUMMARY OF THE INVENTION

The present invention provides a connection between two metal studs that is easily erected and provides a solid facing into which fasteners can be anchored for securely attaching components to a hollow wall sheathed with sheet rock. The objects of this invention are achieved by providing a connection between standard metal studs with a separate backing connector designed to easily, quickly and securely connect to the studs when they are in place and to provide a member for anchoring into through the sheet rock between the studs.

The first wall stud of the connection has an elongated, vertically disposed, substantially planar web. The web has a given width and has an exterior surface on one side of the web and an interior surface on the opposite side of the web. The first wall stud is also formed with a substantially planar side member laterally connected to the web, the side member being disposed orthogonally to the web and running alongside the web, the side member extending from the interior surface side of the web and having an outer surface on one side of the side member and an interior surface on the opposite side of the side member. The first wall stud also has a substantially planar lip flange laterally connected to the side member opposite from the web, the lip flange being disposed parallel to the web and orthogonally to the side member, the lip flange running alongside the side member and being disposed on the interior surface side of the web. The lip flange has a selected width that is substantially narrower than the web. The lip flange has an interior surface that faces the interior surface of the web on one side of the lip flange and a facing surface on the opposite side of the lip flange.

The second wall stud of the connection is disposed in parallel relation to the first wall stud and is spaced a selected distance away from the first wall stud such that the first wall stud and the second wall stud are not in contact. Similar to the first wall stud, the second wall stud has an elongated, vertically disposed, substantially planar web, the web having a given width that is the same as the width of the web of the first wall stud. The web of the second wall stud has an exterior surface on one side of the web and an interior surface on the opposite side of the web. The second wall stud is also formed with a substantially planar side member laterally connected to the web of the second wall stud. The side member is disposed orthogonally to the web and runs alongside the web of the second wall stud. The side member extends from the interior surface side of the web and has an outer surface. The side member of the second wall stud also has a substantially planar lip flange laterally connected to the side member opposite from the web. The lip flange is disposed parallel to the web and orthogonally to the side member of the second wall stud. The lip flange runs alongside the side member and is disposed on the interior surface side of the web. The lip flange has a selected width that is substantially narrower than the web and is the same as the selected width of the lip flange of the first stud.

As is common in most stick-frame construction, the first wall stud is also disposed in relation to the second wall stud such that exterior surface of the web of the second wall stud is closest to the interior surface of the web of the first wall stud and the outer surfaces of the first and second side members of the wall studs are substantially parallel.

The backing connector of the connection is disposed substantially orthogonally to the first and second wall studs and connects the first wall stud to the second wall stud. The backing connector has a first elongated, substantially planar backing web having a longitudinal axis with a first end and a second end. The longitudinal axis is disposed substantially orthogonally to the elongated first and second wall studs with the first end of the backing connector being disposed adjacent the first wall stud and the second end of the backing connector being disposed adjacent the second wall stud. The backing web has an exterior surface on one side of the backing web and an interior surface on the opposite side of the backing web. The exterior surface of the backing web is substantially in alignment with the outer surfaces of the side members of the first and second wall studs.

The backing connector is also formed with a substantially planar upper flange laterally connected to the backing web, the upper flange being disposed at an angle to the backing web and running alongside and above the backing web. The upper flange extends from the interior surface side of the backing web a selected distance that is greater than the selected width of the lip flange of the first stud. The backing connector is also formed with a substantially planar lower flange laterally connected to the backing web, the lower flange being disposed at an angle to the backing web and running alongside and below the backing web. The lower flange extends from the interior surface side of the backing web a selected distance that is greater than the selected width of the lip flange of the first stud.

To make the connection to the first wall stud, the upper and lower flanges at the first end of the backing connector extend past the lip flange of the first stud towards the interior surface of the web of the first wall stud, and the upper and lower flanges are each formed with a notch where the upper and lower flanges receive the lip flange of the first wall stud, and a first end projecting tab if formed on the backing connector that is connected to the backing web at the first end of the backing web and extends generally parallel to the backing web. The first end projecting tab interfaces with a portion of the outer surface of the side member of the first wall stud. In the preferred embodiment, two such first end projecting tabs are provided near the upper and lower reinforcing flanges.

To make the connection to the second wall stud, the second end of the backing connector interfaces with portions of one or more of the exterior surface of the second wall stud or the outer surface of the side member of the second wall stud, but does not interface with or contact the lip flange of the second wall stud, and separate fasteners connect the second end of the backing connector to the second wall stud where the second end of the backing connector interfaces with the second wall stud.

To make a more secure connection between the backing connector and the first wall stud, the material of the upper and lower flanges is disposed on both sides of the lip flange of the first wall stud such that the lip flange of the first wall stud is disposed between material of the upper and lower flanges.

Also to make the connection more secure, the upper and lower flanges at the second end of the backing connector can extend to and make contact with the exterior surface of the second wall stud. In the preferred embodiment, a stabilizing flange is angularly attached to and formed from the material of both the upper and lower flanges respectively at the second end of the backing connector, and these stabilizing flanges interface with the exterior surface of the web of the second wall stud.

Also to make the connection more secure, the upper and lower flanges at the first end of the backing connector are formed with foot tabs that are disposed at an angle to the upper and lower flanges and interface with interior surface of the first side member.

It is also an object of the present invention to provide a backing connector that can be adjusted to span a variety of selected distances between the first and second studs. This is accomplished by forming the backing connector as two portions, an inner portion and an outer portion with the inner portion received within the outer portion such that the inner and outer portions slidingly engage with each other. In this form of the invention the upper and lower flanges at the second end of the backing connector are formed with reinforcing flanges attached to the upper and lower flanges opposite from the backing web, and the backing web at and near the second end of the connector has an inner part and an outer part that are in overlapping and interfacing engagement, and the upper and lower flanges at and near the second end of the backing connector have an inner part and an outer part that are in overlapping and interfacing engagement, and the reinforcing flanges of the upper and lower flanges at and near the second end of the backing connector have an inner part and an outer part that are in overlapping and interfacing engagement with each other.

In the preferred embodiment of the present invention, the entire length of both the upper flange and the lower flange are formed with the reinforcing flanges, as the reinforcing flanges add rigidity to the backing connector; however, the reinforcing flanges do not need to extend to the first end of the backing connector.

To further achieve the object of making a secure connection, a first end abutment flange is angularly joined to the first end of the backing web. The first end abutment flange interfaces with the facing surface of the lip flange of the first wall stud. Similarly, a second end abutment flange is angularly joined to the second end of the backing web and interfaces with the exterior surface of the web of the second wall stud.

Also to further achieve the object of making a secure connection, a second end projecting tab is connected to the backing web at the second end of the backing web and extends generally parallel to the backing web. The second end projecting tab interfaces with a portion of the outer surface of the side member of the second wall stud. In the preferred embodiment, two such second end projecting tabs are provided near the upper and lower flanges. The first and second end projecting tabs preferably extend less than half the distance across the side members of the wall studs, such that it is easy to install backing connectors at the same level across multiple pairs of studs.

In the preferred embodiment, and in order to make a more secure connection, fasteners also connect the first end of the backing connector to the first wall stud. The preferred fasteners are self-drilling, self-tapping metal screws. In the preferred embodiment, one fastener is driven through each of the first end projecting tabs into the side member of the first wall stud. Also, in the preferred embodiment, one fastener is driven through each of the stabilizing flanges into the web member of the second wall stud.

It is a further object of the present invention to provide a method of easily making a connection between a first wall stud and a second wall stud with a backing connector. The connection of the present invention is made by first positioning the notches of the upper and lower flanges at the first end of the backing connector so that they receive the lip flange of the first wall stud. Next, the second end of the backing connector is brought into engagement with the second wall stud by rotating the backing connector and by adjusting the relative engagement of the inner part and an outer part of the backing web, the inner part and outer part of the upper and lower flanges, and the inner part and outer part of the reinforcing flanges so that the backing connector is long enough to form an interfacing engagement with certain surfaces of the second wall stud. In the last step, fasteners are driven through selected members at the ends of the backing connector and into the first and second wall studs.

DETAILED DESCRIPTION OF THE INVENTION

Figure 1:
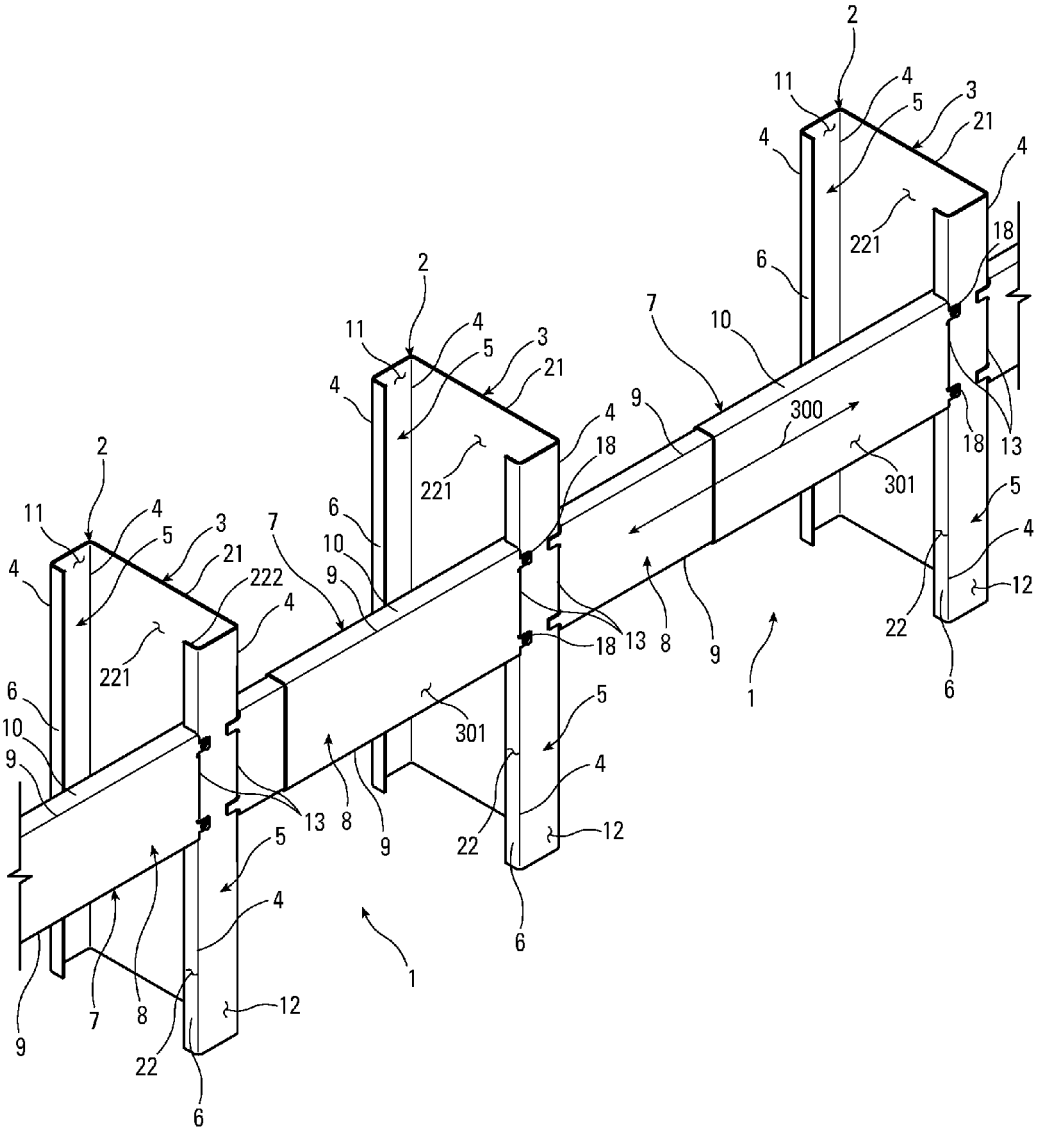
FIG. 1 is an upper front right perspective view of multiple connections made according to the present invention between a plurality of wall studs and the backing connector of the present invention, showing the same connector installed between wall stud pairs with differing spacing.

As shown in FIG. 1, in the preferred embodiment, the drywall backing connection 1 of the present invention includes a first wall stud 2 having a first stud web 3 with a first vertical edge 4, a first side flange or side member 5 extending from the first vertical edge 4, the first side flange 5 having a second vertical edge 4, and a lip flange 6 extending from the second vertical edge 4. The elongated, vertically disposed, substantially planar web 3 has a given width and has an exterior surface 21 on one side of the web 3 and an interior surface 221 on the opposite side of the web 3. The substantially planar side member 5 laterally connected to the web 3 is disposed orthogonally to the web 3 and runs alongside the web 3. The side member 5 extends from the interior surface side 221 of the web and has an outer surface 12 on one side of the side member 5 and an interior surface 11 on the opposite side of the side member 5. The substantially planar lip flange 6 is laterally connected to the side member 5 opposite from the web 3. The lip flange 6 is disposed parallel to the web 3 and orthogonally to the side member 5. The lip flange runs alongside the side member 5 and is disposed on the interior surface side 221 of the web 3, such that lip flange 6 is closer to the second wall stud 2 than the web 3 of the first wall stud 2, with the second wall stud being defined as the wall stud 2 to which the second end 13 of the backing connector 7 is attached. As shown in FIG. 1, the wall studs 2 can serve as either the first wall stud 2 of a particular connection with a backing connector 7 or the second wall stud 2 of a different connection with a backing connector 7. The lip flange 6 has a selected width that is substantially narrower than the web 3, the lip flange 6 has an interior surface 222 that faces the interior surface 221 of the web 3 on one side of the lip flange 6 and a facing surface 22 on the opposite side of the lip flange 6.

Similarly, in the preferred embodiment, a second wall stud 2 has a first stud web 3 with a first vertical edge 4, a first side flange or side member 5 extending from the first vertical edge 4, the first side flange 5 having a second vertical edge 4, and a first lip flange 6 extending from the second vertical edge 4. The second wall stud 2 is disposed in parallel relation to the first wall stud 2 and spaced a selected distance away from the first wall stud 2 such that the first wall stud 2 and the second wall stud 2 are not in contact. The elongated, vertically disposed, substantially planar web 3 has a given width that is the same as the width of the web 3 of the first wall stud 2, the web 3 also has an exterior surface 21 on one side of the web 3 and an interior surface 221 on the opposite side of the web 3. The substantially planar side member 5 laterally connected to the web 3 of the second wall stud 2 is disposed orthogonally to the web 3 and runs alongside the web 3 of the second wall stud 2. The side member 5 extends from the interior surface side 221 of the web 3 and has an outer surface 12 on one side of the side member 5 and an interior surface 11 on the opposite side of the side member 5. The substantially planar lip flange 6 is laterally connected to the side member 5 opposite from the web 3. The lip flange 6 is disposed parallel to the web 3 and orthogonally to the side member 5. The lip flange runs alongside the side member 5 and is disposed on the interior surface side 221 of the web 3 the lip flange. The lip flange 6 has a selected width that is substantially narrower than the web 3, the lip flange 6 has an interior surface 222 that faces the interior surface 221 of the web 3 on one side of the lip flange 6 and a facing surface 22 on the opposite side of the lip flange 6.

Figure 2:
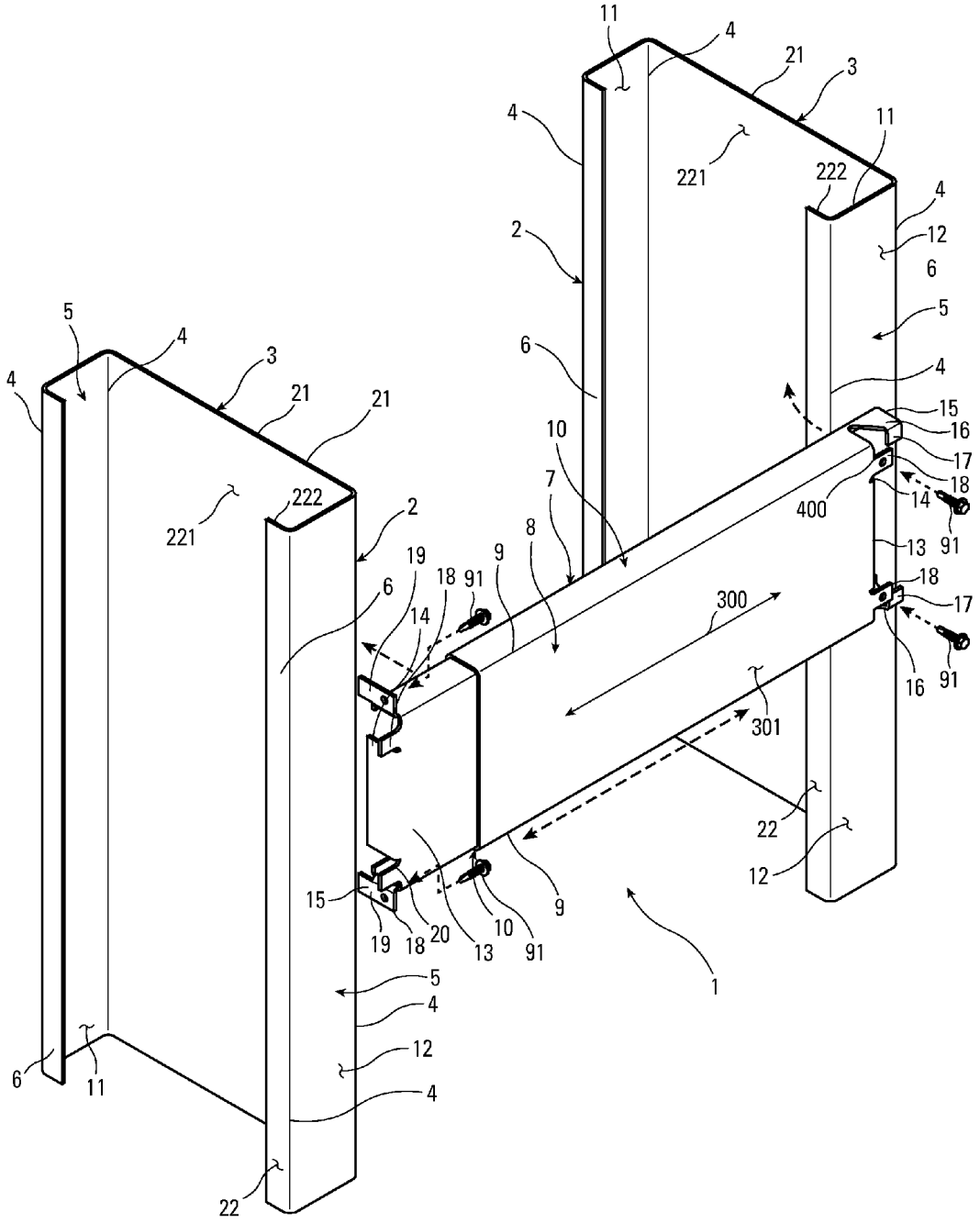
FIG. 2 is an upper front right perspective view of a backing connector of the present invention being installed between a pair of wall studs.

In any particular connection with a single selected backing connector 7, connecting a first wall stud 2 and a second wall stud 2, as shown in FIG. 2, the first wall stud 2 is disposed such that exterior surface 21 of the web 3 of the second wall stud 2 is closest to the interior surface 221 of the web 3 of the first wall stud 2 and the outer surfaces 12 of the first and second side members 5 are substantially parallel.

As shown in FIG. 1, in the preferred embodiment, the preferred variable-length, backing connector 7, is formed with a backing web 8, having a first longitudinal side edge 9, a second longitudinal side edge 9, and a first end 13, and a second end 13. In the preferred embodiment, the first and second longitudinal side edges 9 are parallel. An upper longitudinal flange 10 extends at an angle from the first longitudinal edge 9. The upper longitudinal flange 10 has a first end 15 proximate the first end 13 of the first backing web 8, and a second end 15 proximate the second end 13 of the backing web. A lower longitudinal flange 10 extends at an angle from the second longitudinal side edge 9. The lower longitudinal flange 10 has a first end 15 proximate the first end 13 of the backing web 8, and a second end 15 proximate the second end 13 of the backing web 8. In the preferred embodiment, the upper and lower longitudinal flanges 10 are parallel.

The backing connector 7 is disposed substantially orthogonally to the first and second wall studs 2 and connects the first wall stud 2 to the second wall stud 2. As mentioned, the backing connector 7 includes the first elongated, substantially planar backing web 8. The backing web 8 has a longitudinal axis 300 with first and second ends 13. The longitudinal axis 300 is disposed substantially orthogonally to the elongated first and second wall studs 2 with the first end 13 of the backing connector 7 being disposed adjacent the first wall stud 2 and the second end 13 of the backing connector 7 being disposed adjacent the second wall stud 2. The backing web 8 has an exterior surface 301 on one side of the backing web 8 and an interior surface 302 on the opposite side of the backing web 8. The exterior surface 301 of the backing web 8 is substantially in alignment with the outer surfaces 12 of the side members 5 of the first and second wall studs 2.

As noted above the substantially planar upper flange 10 is laterally connected to the backing web 8. The upper flange 10 is disposed at an angle, preferably a 90 degree angle, to the backing web 8 and runs alongside and above the backing web 8. The upper flange 10 extends from the interior surface side 302 of the backing web 8 a selected distance that is greater than the selected width of the lip flange 6 of the first stud 2. As also noted above, the planar lower flange 10 is laterally connected to the backing web 8, the lower flange 10 being disposed at an angle, also preferably 90 degrees, to the backing web 8 and running alongside and below the backing web 8. The longitudinal flange 10 extends from the interior surface side 302 of the backing web 8 a selected distance that is greater than the selected width of the lip flange 6 of the first stud 2.

Figure 3:
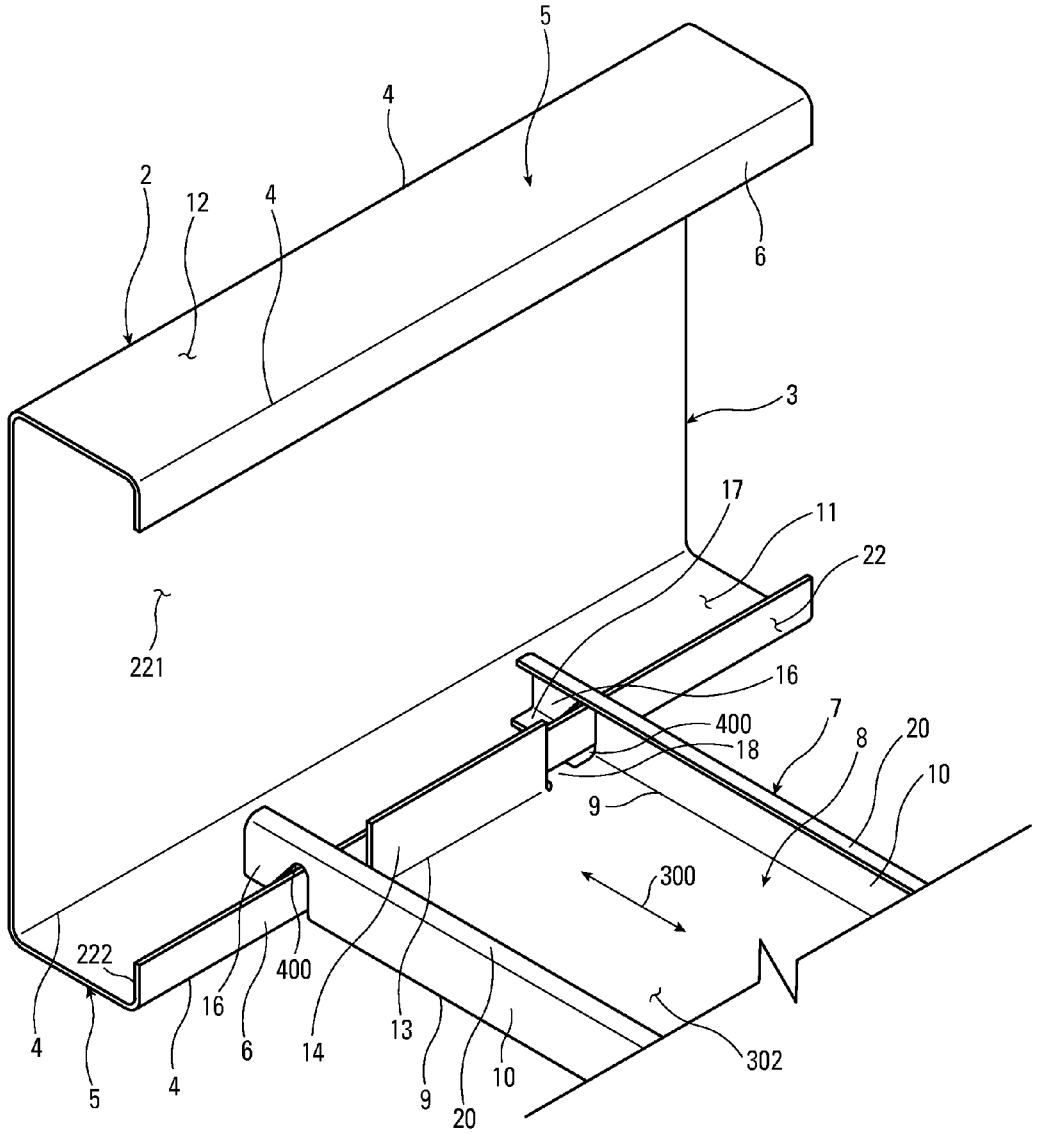
FIG. 3 is a lower rear left perspective view of the notches where the upper and lower flanges of the backing connector of the present invention showing the interface with the side member of a wall stud.

As shown in FIG. 3, the upper and lower flanges 10 at the first end 13 of the backing connector 7 extend past the lip flange 6 of the first stud 2 towards the interior surface 221 of the web 3 of the first wall stud 2, and the upper and lower flanges 10 are each formed with a notch 400 where the upper and lower flanges 10 receive the lip flange 3 of the first wall stud 2.

Figure 4:
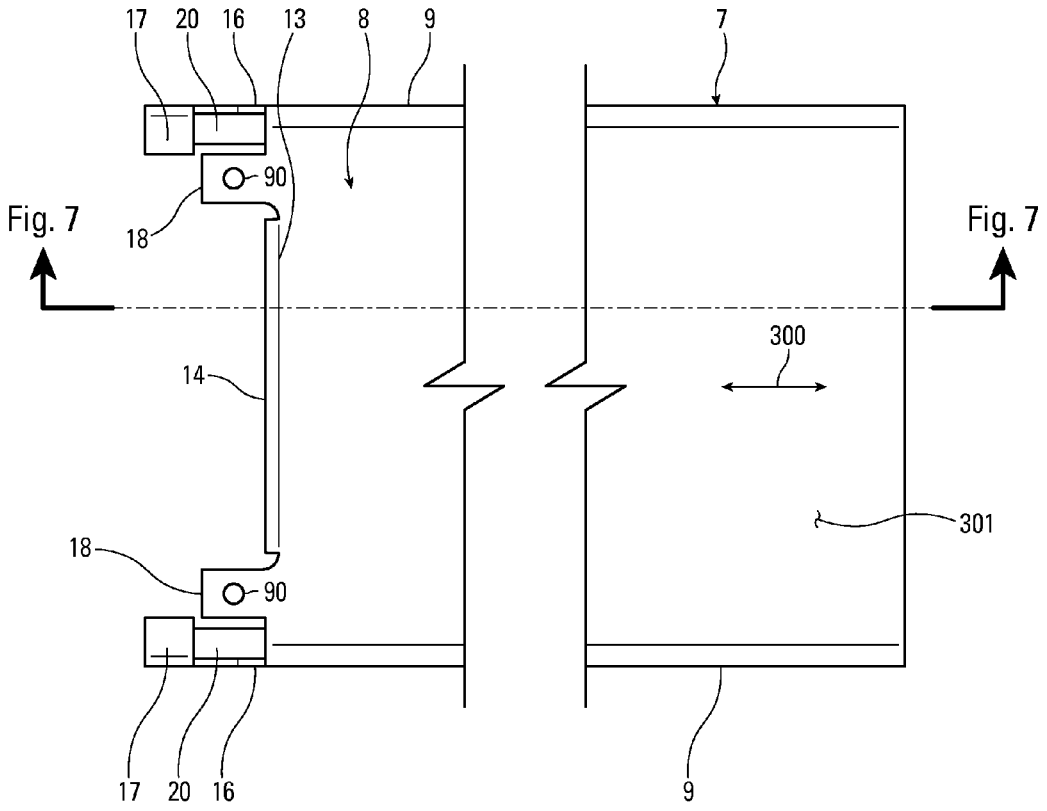
FIG. 4 is a front elevation view of the part of the backing connector of the present invention that has notches in its upper and lower flanges.
Figure 5:
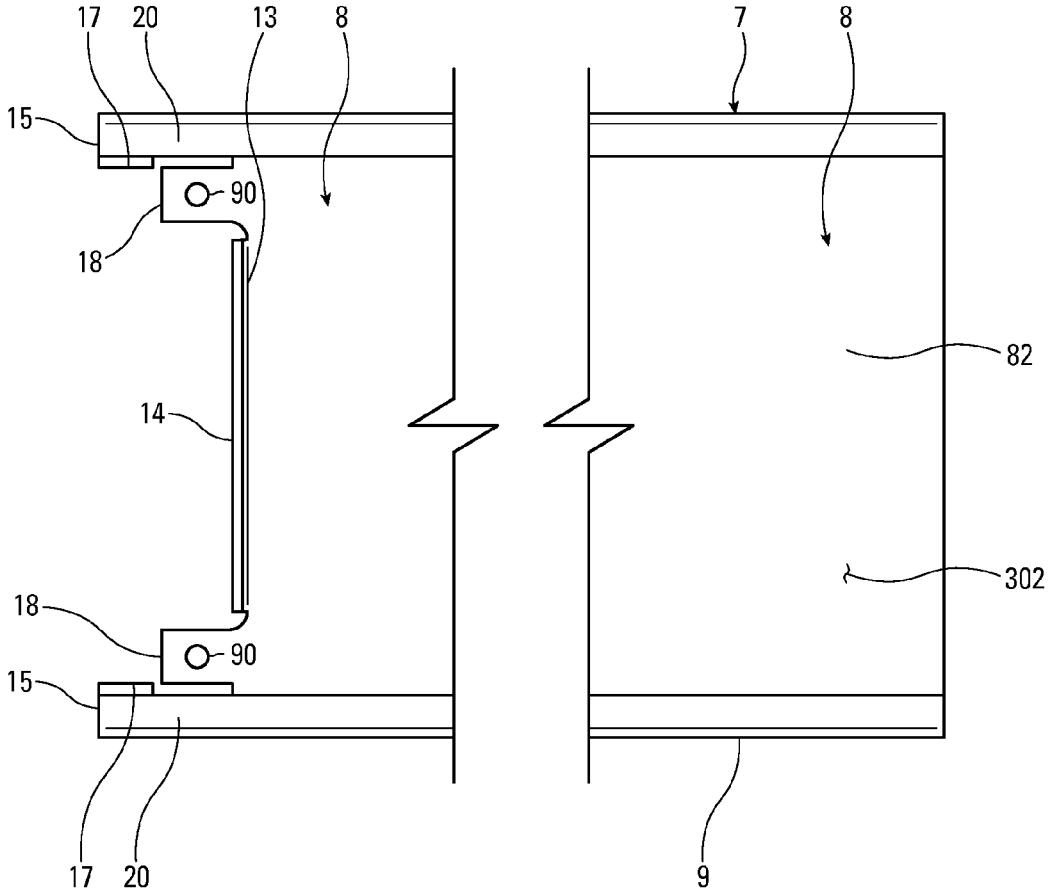
FIG. 5 is a back elevation view of the part of the backing connector shown in FIG. 4.
Figure 6:
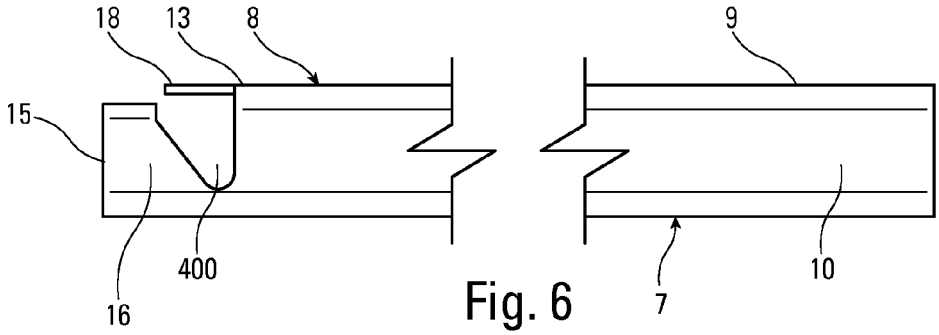
FIG. 6 is a top plan view of the part of the backing connector shown in FIG. 4.
Figure 7:
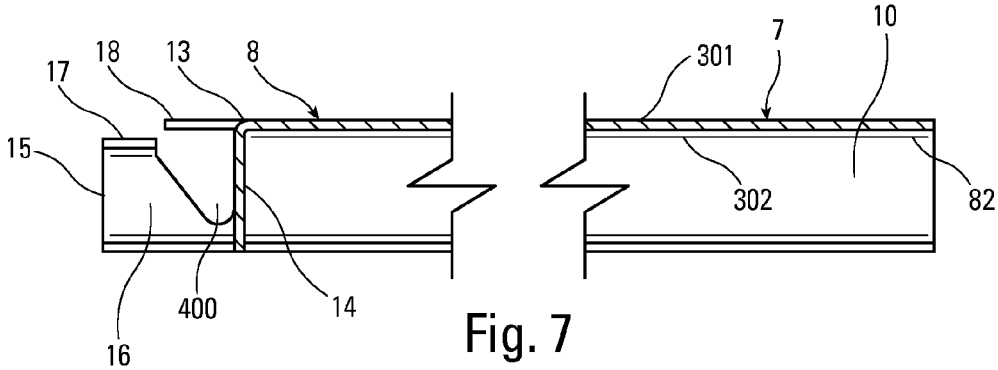
FIG. 7 is a top plan cutaway view of the part of the backing connector shown in FIG. 4 and taken along line 7-7.
Figure 8:
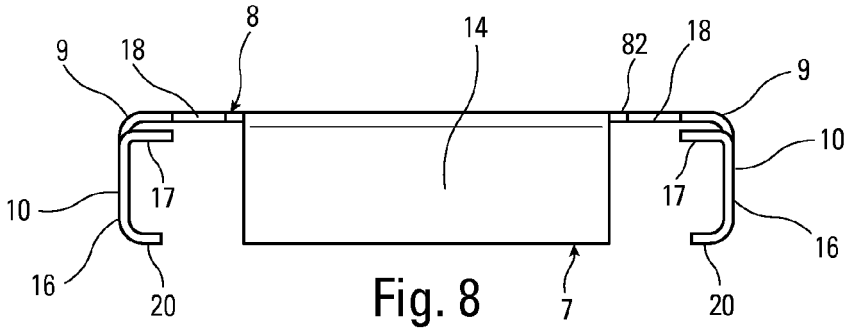
FIG. 8 is a right end elevation view of the part of the backing connector shown in FIG. 4.
Figure 9:
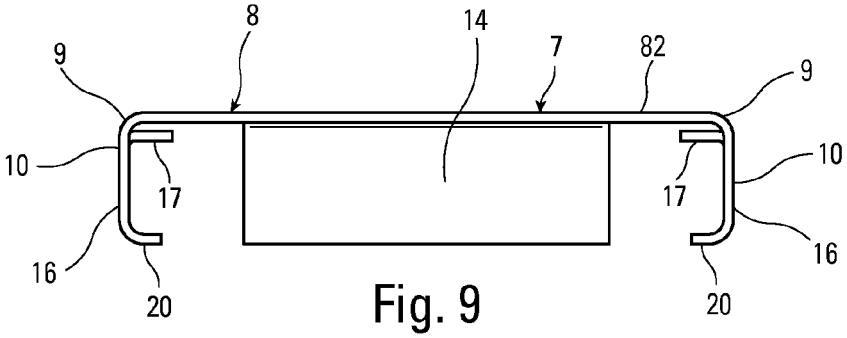
FIG. 9 is a left end elevation view of the part of the backing connector shown in FIG. 4.
Figure 10:
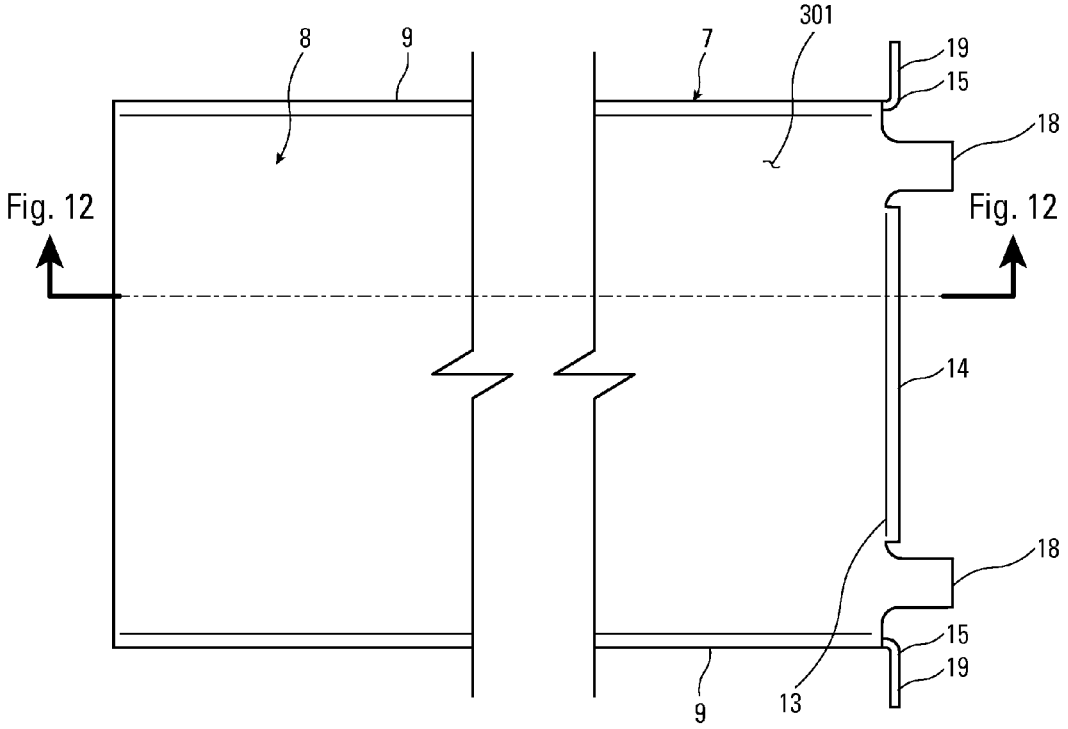
FIG. 10 is a front elevation view of the part of the backing connector of the present invention that does not have notches in its upper and lower flanges.
Figure 11:
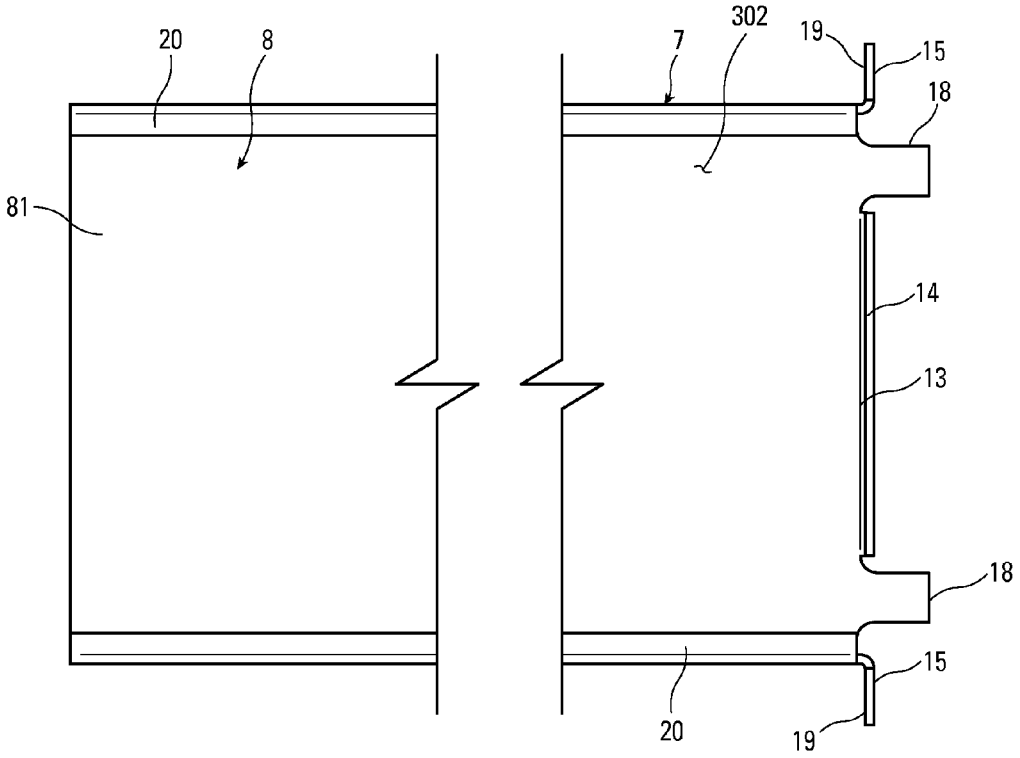
FIG. 11 is a back elevation view of the part of the backing connector shown in FIG. 10.
Figure 12:
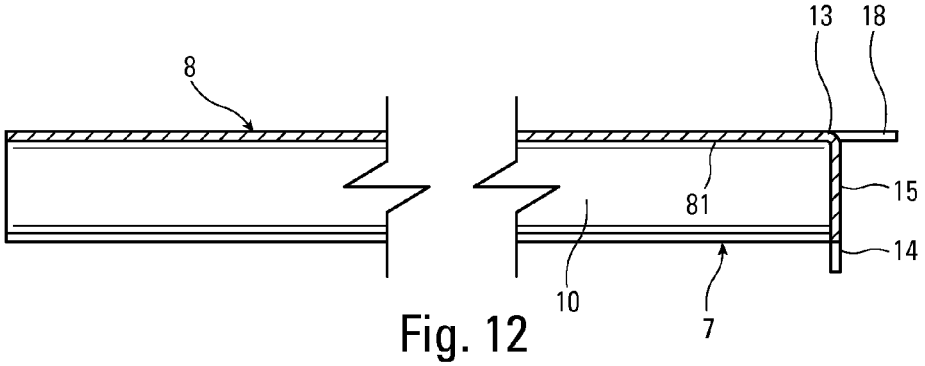
FIG. 12 is a top plan cutaway view of the part of the backing connector shown in FIG. 10 and taken along line 12-12.
Figure 13:
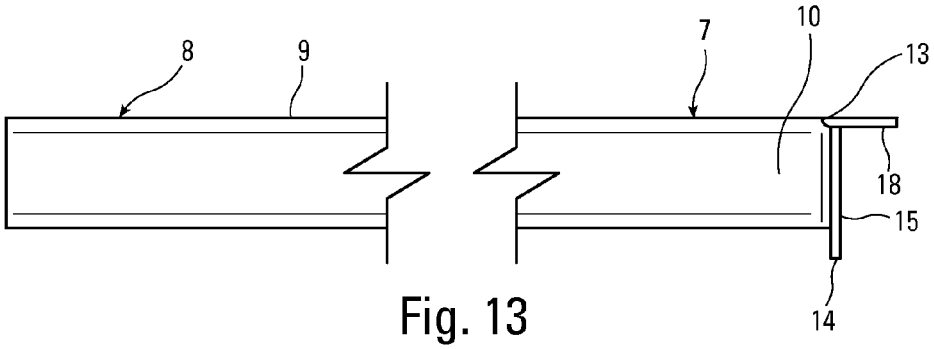
FIG. 13 is a top plan view of the part of the backing connector shown in FIG. 10.
Figure 14:
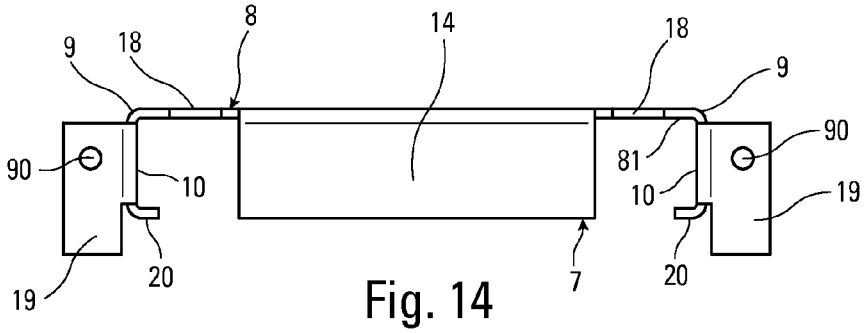
FIG. 14 is a left end elevation view of the part of the backing connector shown in FIG. 10.
Figure 15:
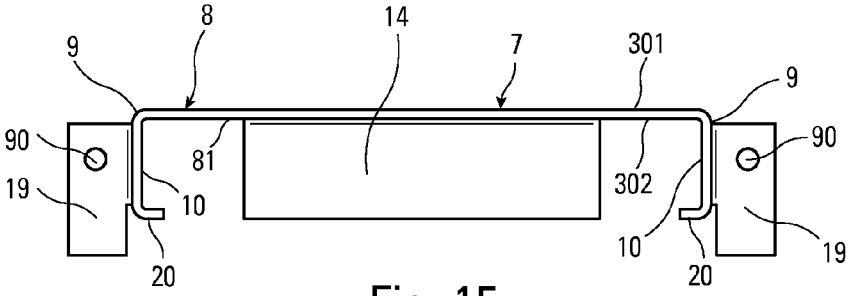
FIG. 15 is a right end elevation view of the part of the backing connector shown in FIG. 10.
Figure 16:
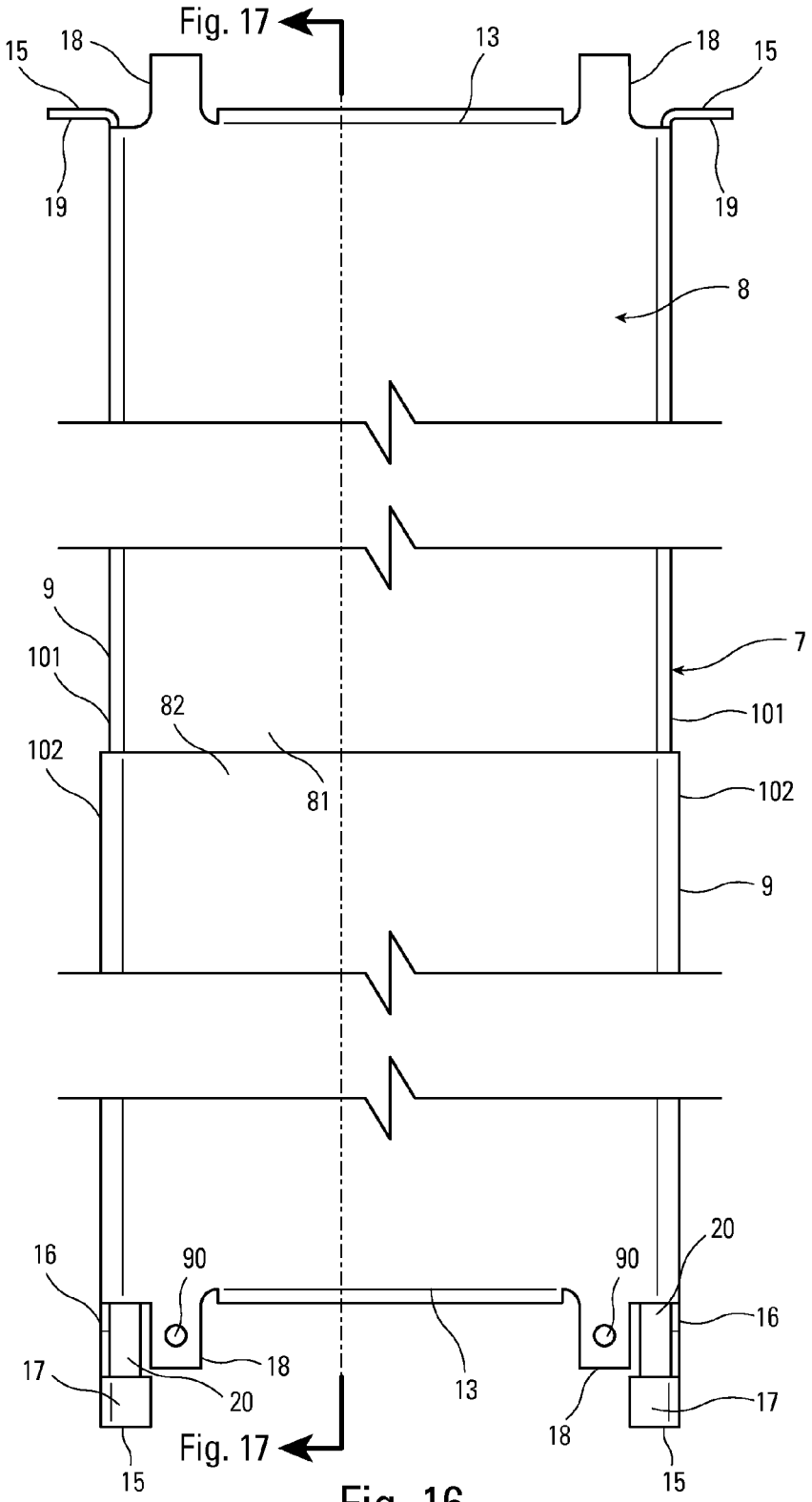
FIG. 16 is a front elevation view of the part of the whole backing connector of the present invention.
Figure 17:
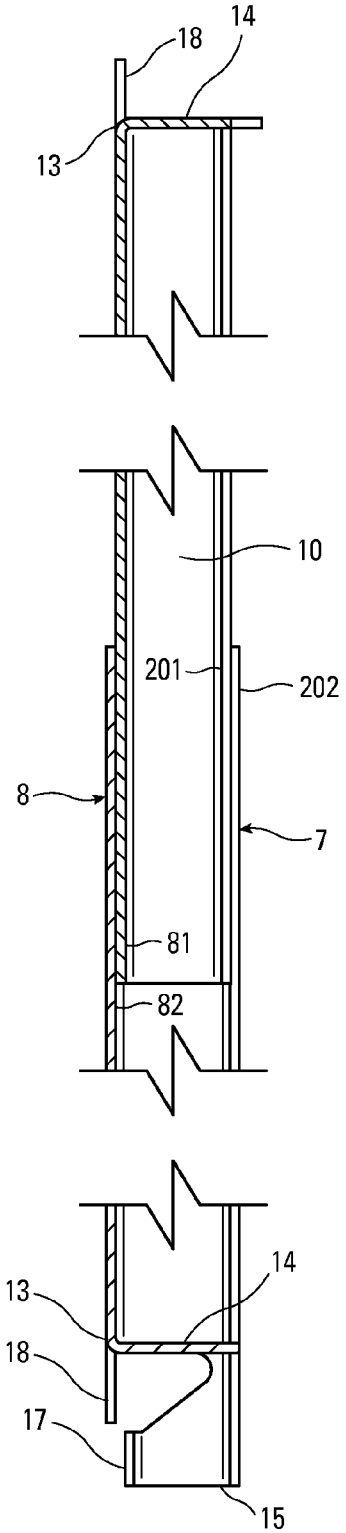
FIG. 17 is a top plan cutaway view of the part of the backing connector shown in FIG. 16 and taken along line 17-17.
Figure 18:
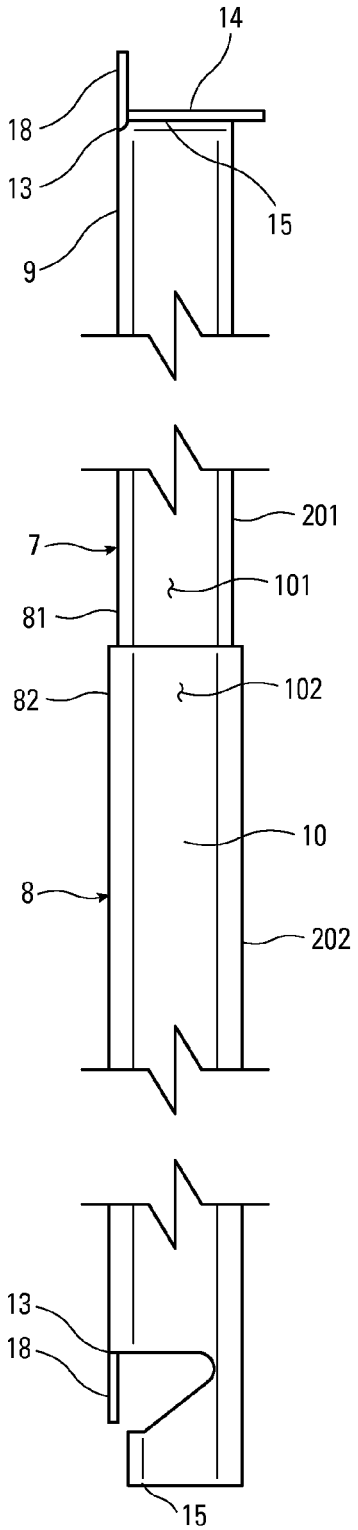
FIG. 18 is a top plan view of the part of the backing connector shown in FIG. 16.

As best shown in FIGS. 1, 4 and 5, the backing connector 7 is also formed with a first end projecting tab 18 that is connected to the backing web 8 at said first end 13 of the backing web 8 and extends generally parallel to the backing web 8, the first end projecting tab 18 interfacing with a portion of the outer surface 12 of the side member 5 of the first wall stud 2. In the preferred embodiment the backing connector 7 is formed with a pair of first end projecting tabs 18 near the upper and lower longitudinal flanges 10.

In the preferred embodiment, the first ends of the upper and lower flanges 10 are formed with a first L-shaped end tabs 16 that extend over the first lip flange 6 of the first wall stud 2.

As shown in FIGS. 1 and 2, the backing connector 7 is fastened to the second wall stud 2 proximate the second web end 13. The second end 13 of the backing connector 7 interfaces with portions of one or more of the exterior surface 21 of the second wall stud 2 or the outer surface 12 of the side member 5 of the second wall stud 2, but does not interface with or contact the lip flange 6 of the second wall stud 2. As shown in FIG. 2, one or more fasteners 91 connect the second end 13 of the backing connector 7 to the second wall stud 2 where the second end 13 of the backing connector 7 interfaces with the second wall stud 2.

As shown in FIG. 3, material of the upper and lower flanges 10 is disposed on both sides of the lip flange 6 of the first wall stud 2 such that the lip flange 6 of the first wall stud 2 is disposed between the material of the upper and lower flanges 10. Preferably, the notch 400 is provided with an orthogonally disposed to the longitudinal axis 300 of the backing member 7 abutment edge that contacts and can interface along the facing surface 22 of the lip flange 6, and with an angled edge on the interior surface 222 of the lip flange 6 to allow the backing connector 7 to be easily swung into place over the lip flange 6.

Figure 19:
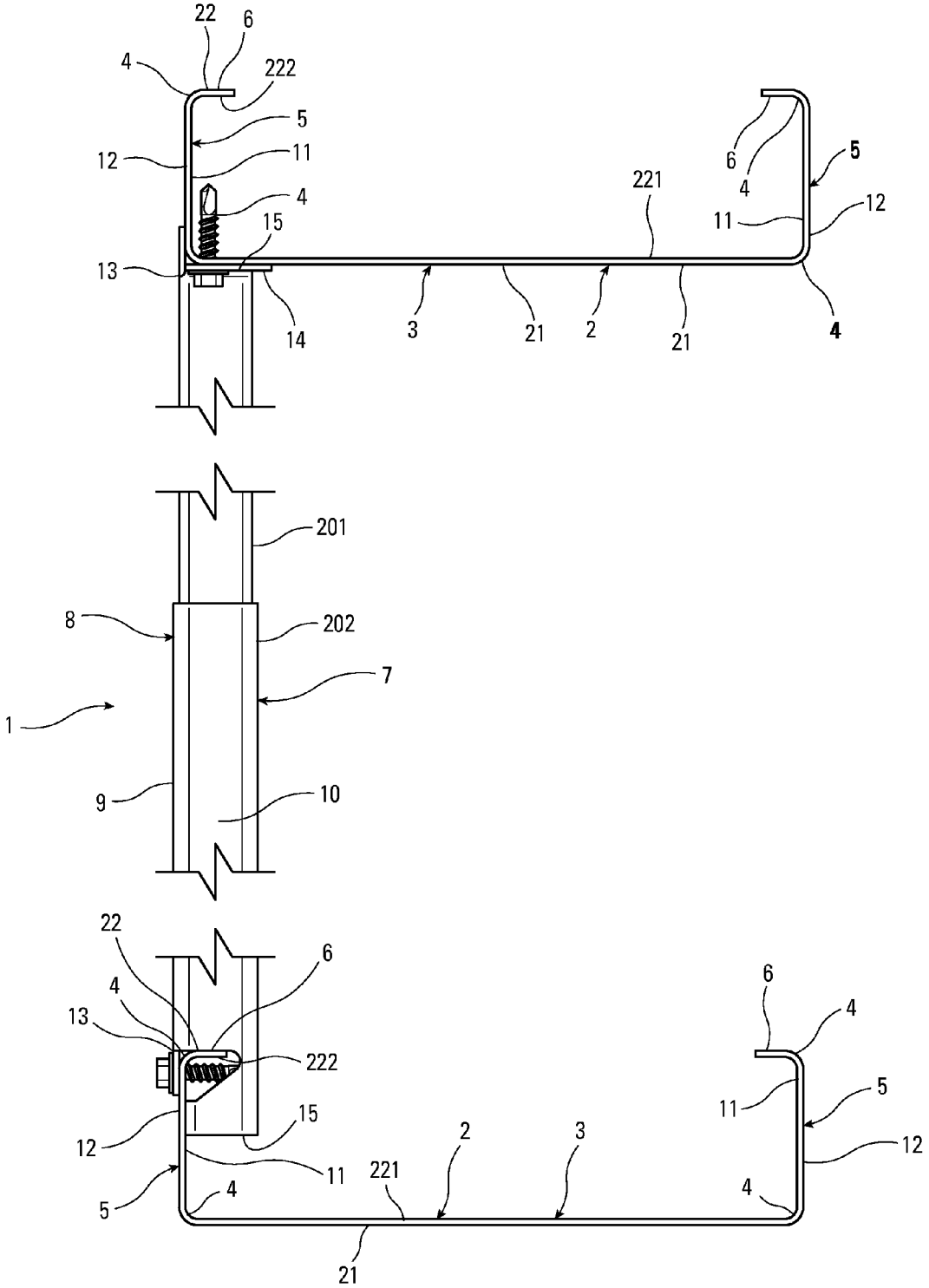
FIG. 19 is a top plan view of a connection made according to the present invention between a pair of wall studs and the backing connector of the present invention.

As shown in FIG. 19, the upper and lower longitudinal flanges 10 at the second end 13 of the backing connector can extend to and make contact with the exterior surface 21 of the second wall stud 2. In the preferred embodiment, a stabilizing flange 19 is angularly attached to and formed from the material of both the upper and lower longitudinal flanges 10 respectively at the second end 13 of the backing connector 7, and these stabilizing flanges 19 interface with the exterior surface 21 of the web 3 of the second wall stud 2. The stabilizing flanges 19 are preferably disposed orthogonally to the longitudinal flanges 10.

As shown in FIGS. 2 and 3, the upper and lower flanges 10 at the first end 13 of the backing connector 7 are formed with foot tabs 17 that are disposed at an angle, preferably a 90 degree angle, to the upper and lower flanges 10 and interface with the interior surface 11 of the first side member 5.

As best shown in FIGS. 1 and 16-19, the backing connector 7 can be adjusted to span a variety of selected distances between the first and second studs 2. This is accomplished by forming the backing connector as two portions, an inner portion and an outer portion with the inner portion received within the outer portion such that the inner and outer portions slidingly engage with each other. In this form of the invention the upper and lower flanges 10 at the second end 13 of the backing connector 7 are formed with reinforcing flanges 20 attached to the upper and lower flanges 10 opposite from the backing web 8, and the backing web 8 at and near the second end 13 of the connector 7 has an inner part 81 and an outer part 82 that are in overlapping and interfacing engagement, and the upper and lower flanges 10 at and near the second end 13 of the backing connector 7 have an inner part 101 and an outer part 102 that are in overlapping and interfacing engagement, and the reinforcing flanges 20 of the upper and lower flanges 10 at and near the second end 13 of the backing connector 7 have an inner part 201 and an outer part 202 that are in overlapping and interfacing engagement with each other.

In the preferred embodiment of the present invention, the entire length of both the upper flange 10 and the lower flange 10 are formed with the reinforcing flanges 20, as the reinforcing flanges 20 add rigidity to the backing connector 7; however, the reinforcing flanges 20 do not need to extend to the first end 13 of the backing connector 7.

As shown in FIGS. 2, 3, 10 and 14, a first end abutment flange 14 is angularly joined to the first end 13 of the backing web 8. The first end abutment flange 14 interfaces with the facing surface 22 of the lip flange 6 of the first wall stud 2. Similarly, a second end abutment flange 14 is angularly joined to the second end 13 of the backing web 8 and interfaces with the exterior surface 21 of the web 3 of the second wall stud 2. The abutment flanges 14 are preferably disposed orthogonally to the backing web 8.

As shown in FIG. 1, a second end projecting tab 18 is connected to the backing web 8 at the second end 13 of the backing web 8 and extends generally parallel to the backing web 8. The second end projecting tab 18 interfaces with a portion of the outer surface 12 of the side member 5 of the second wall stud 2. In the preferred embodiment, two such second end projecting tabs 18 are provided near the upper and lower flanges 10. The first and second end projecting tabs preferably extend less than half the distance across the side member 5 of the wall studs 2, such that it is easy to install backing connectors 7 at the same level across multiple pairs of studs 2.

In the preferred embodiment, and in order to make a more secure connection, fasteners 91 also connect the first end 13 of the backing connector 7 to the first wall stud 2. The preferred fasteners 91 are self-drilling, self-tapping metal screws. In the preferred embodiment, one fastener 91 is driven through each of the first end projecting tabs 18 into the side member 5 of the first wall stud 2. Also, in the preferred embodiment, one fastener 91 is driven through each of the stabilizing flanges 19 into the web member 3 of the second wall stud 2.

As best shown in FIG. 2, the connection of the present invention is made by first positioning the notches 400 of the upper and lower flanges 10 at the first end 13 of the backing connector 7 so that they receive the lip flange 6 of the first wall stud 2. Next, the second end 13 of the backing connector 7 is brought into engagement with the second wall stud 2 by rotating the backing connector 7 and by adjusting the relative engagement of the inner part 81 and an outer part 82 of the backing web, the inner part 101 and outer part 102 of the upper and lower flanges 10, and the inner part 201 and outer part 202 of the reinforcing flanges 20 so that the backing connector 7 is long enough to form an interfacing engagement with certain surfaces of the second wall stud 2. In the last step, fasteners 91 are driven through selected members, preferably in preformed fastener openings 90, at the ends 13 of the backing connector 7 and into the first and second wall studs 2.

The preferred backing connector 7 of the present invention is formed from two pieces of sheet metal on a progressive die with the inner part of the two pieces inserted into engagement with the outer part. As noted above, the longitudinal side edges 9 of the backing connector 7 are preferably parallel. The backing connector is preferably formed from a two generally rectangular blanks of sheet metal that allows the pieces to be cut on a progressive die with minimal waste. The parallel side edges 9 also allow the backing connector 7 to be installed at a horizontal level easily. The studs of the present invention are also preferably formed of sheet metal.

As shown in FIG. 1, multiple backing connectors can be attached to side-by-side studs of varying distances between the studs.

I claim:

1. A connection between a first wall stud and a second wall stud, the connection comprising:

a. a first wall stud, the first wall stud including, i. an elongated, vertically disposed, substantially planar web, the web having a given width and having an exterior surface on one side of the web and an interior surface on the opposite side of the web, ii. a substantially planar side member laterally connected to the web, the side member being disposed orthogonally to the web and running alongside the web, the side member extending from the interior surface side of the web and having an outer surface on one side of the side member and an interior surface on the opposite side of the side member, iii. a substantially planar lip flange laterally connected to the side member opposite from the web, the lip flange being disposed parallel to the web and orthogonally to the side member, the lip flange running alongside the side member and being disposed on the interior surface side of the web, the lip flange having a selected width that is substantially narrower than the web, the lip flange having an interior surface that faces the interior surface of the web on one side of the lip flange and a facing surface on the opposite side of the lip flange;

b. a second wall stud disposed in parallel relation to the first wall stud and spaced a selected distance away from the first wall stud such that the first wall stud and the second wall stud are not in contact, the second wall stud including, i. an elongated, vertically disposed, substantially planar web, the web having a given width that is the same as the width of the web of the first wall stud, the web also having an exterior surface on one side of the web and an interior surface on the opposite side of the web, ii. a substantially planar side member laterally connected to the web of the second wall stud, the side member being disposed orthogonally to the web and running alongside the web of the second wall stud, the side member extending from the interior surface side of the web and having an outer surface, iii. a substantially planar lip flange laterally connected to the side member opposite from the web, the lip flange being disposed parallel to the web and orthogonally to the side member of the second wall stud, the lip flange running alongside the side member and being disposed on the interior surface side of the web, the lip flange having a selected width that is substantially narrower than the web and is the same as the selected width of the lip flange of the first stud, and iv. the first wall stud is disposed such that exterior surface of the web of the second wall stud is closest to the interior surface of the web of the first wall stud and the outer surfaces of the first and second side members are substantially parallel;

c. a backing connector, the backing connector being disposed substantially orthogonally to the first and second wall studs and connecting the first wall stud to the second wall stud, the backing connector including, i. a first elongated, substantially planar backing web having a longitudinal axis with a first end and a second end, the longitudinal axis being disposed substantially orthogonally to the elongated first and second wall studs with the first end of the backing connector being disposed adjacent the first wall stud and the second end of the backing connector being disposed adjacent the second wall stud, the backing web having an exterior surface on one side of the backing web and an interior surface on the opposite side of the backing web, the exterior surface of the backing web being substantially in alignment with the outer surfaces of the side members of the first and second wall studs, ii. a substantially planar upper flange laterally connected to the backing web, the upper flange being disposed at an angle to the backing web and running alongside and above the backing web, the upper flange extending from the interior surface side of the backing web a selected distance that is greater than the selected width of the lip flange of the first stud, iii. a substantially planar lower flange laterally connected to the backing web, the lower flange being disposed at an angle to the backing web and running alongside and below the backing web, the lower flange extending from the interior surface side of the backing web a selected distance that is greater than the selected width of the lip flange of the first stud, iv. the upper and lower flanges at the first end of the backing connector extending past the lip flange of the first stud towards the interior surface of the web of the first wall stud, and the upper and lower flanges are each formed with a notch where the upper and lower flanges receive the lip flange of the first wall stud, v. a first end projecting tab that is connected to said backing web at said first end of said backing web and extends generally parallel to the backing web, said first end projecting tab interfacing with a portion of said outer surface of said side member of said first wall stud, and wherein vi. the second end of the backing connector interfaces with portions of one or more of the exterior surface of the second wall stud or the outer surface of the side member of the second wall stud, but does not interface with or contact the lip flange of the second wall stud; and wherein vii. a foot tab is connected to the upper flange at the first end of the backing connector and interfaces with the interior surface of the first side member; and viii. a foot tab is connected to the lower flange at the first end of the backing connector and interfaces with the interior surface of the first side member, and d. one or more fasteners for connecting the second end of the backing connector to the second wall stud where the second end of the backing connector interfaces with the second wall stud.

2. The connection of claim 1, wherein:

material of both the upper and lower flanges is disposed on both sides of the lip flange of the first wall stud.

3. The connection of claim 1, wherein:

a first end abutment flange is angularly joined to the first end of the backing web, and said first end abutment flange interfaces with the facing surface of the lip flange of the first wall stud.

4. The connection of claim 1, wherein:

a second end abutment flange is angularly joined to the second end of the backing web, and said second end abutment flange interfaces with the exterior surface of the web of the second wall stud.

5. The connection of claim 1, wherein:

a second end projecting tab is connected to said backing web at said second end of said backing web and extends generally parallel to the backing web, said second end projecting tab interfacing with a portion of said outer surface of said side member of said second wall stud.

6. The connection of claim 1, wherein:

fasteners also connect the first end of the backing connector to the first wall stud where the first end of the backing connector interfaces with the first wall stud.

7. The connection of claim 6, wherein:

a. said backing connector is made with a plurality of first end projecting tabs; and b. said fasteners that connect said first end of said backing connector to the first wall stud connect said first end projecting tabs to said outer surface of the side member of the first wall stud.

8. The connection of claim 1, wherein:

the upper and lower flanges at and near the second end of the backing connector are formed with elongated reinforcing flanges attached to the upper and lower flanges opposite from the backing web.

9. The connection of claim 8, wherein:

a. the backing web at and near the second end of the connector has an inner part and an outer part that are in overlapping and interfacing engagement;

b. the upper and lower flanges at and near the second end of the backing connector have an inner part and an outer part that are in overlapping and interfacing engagement, and c. the reinforcing flanges of the upper and lower flanges at and near the second end of the backing connector have an inner part and an outer part that are in overlapping and interfacing engagement with each other.

10. A method of making the connection of claim 9, wherein:

a. the notches of the upper and lower flanges at the first end of the backing connector are positioned so that they receive the lip flange of the first wall stud, b. followed by bringing the second end of the backing connector into engagement with the second wall stud by rotating the backing connector and by adjusting the relative engagement of the inner part and an outer part of the backing web, the inner part and outer part of the upper and lower flanges, and the inner part and outer part of the reinforcing flanges;

c. followed by fastening the first and second ends of the backing connector to the first and second wall studs.

11. The method of making the connection of claim 10, wherein:

a. said backing connector is made with a plurality of first end projecting tabs; and b. said fasteners that connect said first end of said backing connector to the first wall stud connect said first end projecting tabs to said outer surface of the side member of the first wall stud.

12. The method of making the connection of claim 10, wherein:

a. a stabilizing flange is angularly attached to the second end of the upper flange and interfaces with the exterior surface of the web of the second wall stud; and b. a stabilizing flange is angularly attached to the second end of the lower flange and interfaces with the exterior surface of the web of the second wall stud.

13. The connection of claim 12, wherein:

said fasteners that connect said second end of said backing connector to said second wall stud connect said stabilizing flanges of said upper and lower flanges to said exterior surface of the web of the second wall stud.

14. The connection of claim 8, wherein:

the reinforcing flanges of the upper flange and the lower flange extend to the first end of the backing connector.

15. The connection of claim 1, wherein:

the upper and lower flanges at the second end of the backing connector extend to the exterior surface of the web of the second wall stud.

16. The connection of claim 15, wherein:

a. a stabilizing flange is angularly attached to the second end of the upper flange and interfaces with the exterior surface of the web of the second wall stud; and b. a stabilizing flange is angularly attached to the second end of the lower flange and interfaces with the exterior surface of the web of the second wall stud.

17. The connection of claim 15, wherein:

a. said fasteners that connect said second end of said backing connector to said second wall stud connect said stabilizing flanges of said upper and lower flanges to said exterior surface of the web of the second wall stud.

18. A connection between a first wall stud and a second wall stud, the connection comprising:

a. a first wall stud, the first wall stud including, i. an elongated, vertically disposed, substantially planar web, the web having a given width and having an exterior surface on one side of the web and an interior surface on the opposite side of the web, ii. a substantially planar side member laterally connected to the web, the side member being disposed orthogonally to the web and running alongside the web, the side member extending from the interior surface side of the web and having an outer surface on one side of the side member and an interior surface on the opposite side of the side member, iii. a substantially planar lip flange laterally connected to the side member opposite from the web, the lip flange being disposed parallel to the web and orthogonally to the side member, the lip flange running alongside the side member and being disposed on the interior surface side of the web, the lip flange having a selected width that is substantially narrower than the web, the lip flange having an interior surface that faces the interior surface of the web on one side of the lip flange and a facing surface on the opposite side of the lip flange;

b. a second wall stud disposed in parallel relation to the first wall stud and spaced a selected distance away from the first wall stud such that the first wall stud and the second wall stud are not in contact, the second wall stud including, i. an elongated, vertically disposed, substantially planar web, the web having a given width that is the same as the width of the web of the first wall stud, the web also having an exterior surface on one side of the web and an interior surface on the opposite side of the web, ii. a substantially planar side member laterally connected to the web of the second wall stud, the side member being disposed orthogonally to the web and running alongside the web of the second wall stud, the side member extending from the interior surface side of the web and having an outer surface, iii. a substantially planar lip flange laterally connected to the side member opposite from the web, the lip flange being disposed parallel to the web and orthogonally to the side member of the second wall stud, the lip flange running alongside the side member and being disposed on the interior surface side of the web, the lip flange having a selected width that is substantially narrower than the web and is the same as the selected width of the lip flange of the first stud, and iv. the first wall stud is disposed such that exterior surface of the web of the second wall stud is closest to the interior surface of the web of the first wall stud and the outer surfaces of the first and second side members are substantially parallel;

c. a backing connector, the backing connector being disposed substantially orthogonally to the first and second wall studs and connecting the first wall stud to the second wall stud, the backing connector including, i. a first elongated, substantially planar backing web having a longitudinal axis with a first end and a second end, the longitudinal axis being disposed substantially orthogonally to the elongated first and second wall studs with the first end of the backing connector being disposed adjacent the first wall stud and the second end of the backing connector being disposed adjacent the second wall stud, the backing web having an exterior surface on one side of the backing web and an interior surface on the opposite side of the backing web, the exterior surface of the backing web being substantially in alignment with the outer surfaces of the side members of the first and second wall studs, ii. a substantially planar upper flange laterally connected to the backing web, the upper flange being disposed at an angle to the backing web and running alongside and above the backing web, the upper flange extending from the interior surface side of the backing web a selected distance that is greater than the selected width of the lip flange of the first stud, iii. a substantially planar lower flange laterally connected to the backing web, the lower flange being disposed at an angle to the backing web and running alongside and below the backing web, the lower flange extending from the interior surface side of the backing web a selected distance that is greater than the selected width of the lip flange of the first stud, iv. the upper and lower flanges at the first end of the backing connector extending past the lip flange of the first stud towards the interior surface of the web of the first wall stud, and the upper and lower flanges are each formed with a notch where the upper and lower flanges receive the lip flange of the first wall stud, v. a first end projecting tab that is connected to said backing web at said first end of said backing web and extends generally parallel to the backing web, said first end projecting tab interfacing with a portion of said outer surface of said side member of said first wall stud, and wherein vi. the second end of the backing connector interfaces with portions of one or more of the exterior surface of the second wall stud or the outer surface of the side member of the second wall stud, but does not interface with or contact the lip flange of the second wall stud; and wherein vii. a first end abutment flange is angularly joined to the first end of the backing web, and said first end abutment flange interfaces with the facing surface of the lip flange of the first wall stud; and d. one or more fasteners for connecting the second end of the backing connector to the second wall stud where the second end of the backing connector interfaces with the second wall stud.

19. The connection of claim 18, wherein:

material of both the upper and lower flanges is disposed on both sides of the lip flange of the first wall stud.

20. The connection of claim 18, wherein:

a. a foot tab is connected to the upper flange at the first end of the backing connector and interfaces with the interior surface of the first side member; and b. a foot tab is connected to the lower flange at the first end of the backing connector and interfaces with the interior surface of the first side member.

21. The connection of claim 18, wherein:

a second end abutment flange is angularly joined to the second end of the backing web, and said second end abutment flange interfaces with the exterior surface of the web of the second wall stud.

22. The connection of claim 18, wherein:

a second end projecting tab is connected to said backing web at said second end of said backing web and extends generally parallel to the backing web, said second end projecting tab interfacing with a portion of said outer surface of said side member of said second wall stud.

23. The connection of claim 18, wherein:

fasteners also connect the first end of the backing connector to the first wall stud where the first end of the backing connector interfaces with the first wall stud.

24. The connection of claim 23, wherein:

a. said backing connector is made with a plurality of first end projecting tabs; and b. said fasteners that connect said first end of said backing connector to the first wall stud connect said first end projecting tabs to said outer surface of the side member of the first wall stud.

25. The connection of claim 18, wherein:

the upper and lower flanges at and near the second end of the backing connector are formed with elongated reinforcing flanges attached to the upper and lower flanges opposite from the backing web.

26. The connection of claim 25, wherein:

a. the backing web at and near the second end of the connector has an inner part and an outer part that are in overlapping and interfacing engagement;

b. the upper and lower flanges at and near the second end of the backing connector have an inner part and an outer part that are in overlapping and interfacing engagement, and c. the reinforcing flanges of the upper and lower flanges at and near the second end of the backing connector have an inner part and an outer part that are in overlapping and interfacing engagement with each other.

27. A method of making the connection of claim 26, wherein:

a. the notches of the upper and lower flanges at the first end of the backing connector are positioned so that they receive the lip flange of the first wall stud, b. followed by bringing the second end of the backing connector into engagement with the second wall stud by rotating the backing connector and by adjusting the relative engagement of the inner part and an outer part of the backing web, the inner part and outer part of the upper and lower flanges, and the inner part and outer part of the reinforcing flanges;

c. followed by fastening the first and second ends of the backing connector to the first and second wall studs.

28. The method of making the connection of claim 27, wherein:

a. said backing connector is made with a plurality of first end projecting tabs; and b. said fasteners that connect said first end of said backing connector to the first wall stud connect said first end projecting tabs to said outer surface of the side member of the first wall stud.

29. The method of making the connection of claim 27, wherein:

a. a stabilizing flange is angularly attached to the second end of the upper flange and interfaces with the exterior surface of the web of the second wall stud; and b. a stabilizing flange is angularly attached to the second end of the lower flange and interfaces with the exterior surface of the web of the second wall stud.

30. The connection of claim 29, wherein:

said fasteners that connect said second end of said backing connector to said second wall stud connect said stabilizing flanges of said upper and lower flanges to said exterior surface of the web of the second wall stud.

31. The connection of claim 25, wherein:

the reinforcing flanges of the upper flange and the lower flange extend to the first end of the backing connector.

32. The connection of claim 18, wherein:

the upper and lower flanges at the second end of the backing connector extend to the exterior surface of the web of the second wall stud.

33. The connection of claim 32, wherein:

a. a stabilizing flange is angularly attached to the second end of the upper flange and interfaces with the exterior surface of the web of the second wall stud; and b. a stabilizing flange is angularly attached to the second end of the lower flange and interfaces with the exterior surface of the web of the second wall stud.

34. The connection of claim 32, wherein:

a. said fasteners that connect said second end of said backing connector to said second wall stud connect said stabilizing flanges of said upper and lower flanges to said exterior surface of the web of the second wall stud.

* * * * *